US009691230B2

(12) United States Patent
Jackson

(10) Patent No.: US 9,691,230 B2
(45) Date of Patent: Jun. 27, 2017

(54) VIDEO POKER GAME WITH PLAYER HAND DISQUALIFICATION

(71) Applicant: Kathleen Nylund Jackson, Scituate, MA (US)

(72) Inventor: Kathleen Nylund Jackson, Scituate, MA (US)

( * ) Notice: Subject to any disclaimer, the term of this patent is extended or adjusted under 35 U.S.C. 154(b) by 210 days.

(21) Appl. No.: 14/544,581

(22) Filed: Jan. 23, 2015

(65) Prior Publication Data

US 2015/0213689 A1 Jul. 30, 2015

Related U.S. Application Data

(60) Provisional application No. 61/965,324, filed on Jan. 27, 2014.

(51) Int. Cl.
*G07F 17/32* (2006.01)
*A63F 1/00* (2006.01)

(52) U.S. Cl.
CPC ..... *G07F 17/3293* (2013.01); *G07F 17/326* (2013.01); *A63F 2001/005* (2013.01); *G07F 17/3262* (2013.01)

(58) Field of Classification Search
CPC ..... G07F 17/3262; G07F 17/3293; G07F 17/326; A63F 2001/005
See application file for complete search history.

(56) References Cited

U.S. PATENT DOCUMENTS 4,836,553 A 6/1989 Suttle et al.
5,019,973 A 5/1991 Wilcox et al.
5,511,781 A 4/1996 Wood et al.
5,685,774 A 11/1997 Webb
5,782,473 A 7/1998 Chou et al.
5,882,260 A * 3/1999 Marks ..... G07F 17/3293 273/292
6,045,129 A 4/2000 Cooper et al.
6,811,153 B1 11/2004 Ko
7,165,770 B2 * 1/2007 Snow ..... A63F 1/00 273/274
7,247,092 B2 7/2007 Jarvis et al.
7,316,608 B2 * 1/2008 Moody ..... A63F 3/00157 463/13
7,331,579 B2 * 2/2008 Snow ..... A63F 1/00 273/274
7,334,795 B2 * 2/2008 Wonpu ..... A63F 1/00 273/274
7,431,648 B2 10/2008 Odom
7,661,678 B2 2/2010 Snow
7,727,061 B2 6/2010 Taylor
(Continued)

*Primary Examiner* — William H McCulloch, Jr.

(57) ABSTRACT

A method of playing a five card draw video poker wagering game on a gaming device comprising at least a processer, input device and video monitor screen is disclosed. The method comprises providing bonus features in video poker games without requiring an extra wager in addition to a base wager, without lowering the paytable, and basing the paytable on the total wager. In lieu of an extra wager, a predetermined set of dealt hands is automatically disqualified, effectively ending the game and forfeiting the wager. All dealt hands that are not disqualified are qualified hands. The player is eligible to receive at least one randomly-provided bonus feature or guaranteed bonus feature on every qualified hand.

9 Claims, 18 Drawing Sheets

(56) References Cited

U.S. PATENT DOCUMENTS 7,905,776 B2 * 3/2011 Sines ..... A63F 1/00 273/292
8,152,616 B2 * 4/2012 Moody ..... G07F 17/32 273/292
8,282,460 B2 10/2012 Tarantino
8,308,543 B2 11/2012 Miller
8,408,988 B2 4/2013 Miller
8,439,748 B2 5/2013 Walker et al.
8,523,684 B2 9/2013 Lutnick et al.
8,550,892 B2 * 10/2013 Moody ..... G07F 17/32 273/292
8,662,978 B2 3/2014 Miller
9,508,227 B1 * 11/2016 Nottke ..... G07F 17/3267
9,569,935 B2 * 2/2017 Berman ..... G07F 17/3293
2010/0081498 A1 * 4/2010 Moody ..... G07F 17/32 463/25
2010/0259008 A1 * 10/2010 Dinh ..... A63F 1/00 273/303
2012/0238340 A1 9/2012 Alderucci et al.
2012/0299243 A1 * 11/2012 Dinh ..... A63F 1/00 273/292
2014/0135111 A1 5/2014 Taylor
2015/0069704 A1 * 3/2015 Hemberger ..... A63F 1/00 273/292
2015/0141107 A1 * 5/2015 Kowalski ..... G07F 17/3293 463/13
2015/0213689 A1 * 7/2015 Jackson ..... G07F 17/326 463/13
2015/0238846 A1 * 8/2015 Jackson ..... A63F 1/00 273/292
2016/0321875 A1 * 11/2016 Tessmer ..... G07F 17/3293
2016/0328916 A1 * 11/2016 Moody ..... G07F 17/32
2016/0351020 A1 * 12/2016 Berman ..... A63F 3/00157
2016/0371936 A1 * 12/2016 Mendicino ..... G07F 17/3293
2017/0039812 A1 * 2/2017 Baron ..... G07F 17/3258

* cited by examiner

VIDEO POKER GAME WITH PLAYER HAND DISQUALIFICATION

RELATED APPLICATION DATA

This application claims priority from U.S. Provisional Patent Application Ser. No. 61/965,324, filed Jan. 27, 2014, and having the Title VIDEO POKER GAME WITH PLAYER HAND DISQUALIFICATION.

BACKGROUND OF THE INVENTION

1. Field of the Invention

The present invention relates to a poker game suitable for use in casinos and other gaming establishments, as well as wagering or non-wagering space including websites and applications, as a video poker game. The invention further relates to casino gaming wherein a five card draw poker game is played upon an apparatus including a processor, input device and monitor and wherein predetermined deal card combinations may disqualify the player's hand from further play.

2. Background of the Art

The traditional casino table game of poker is played by pitting player against player. Most popular poker table games in brick-and-mortar and virtual casinos worldwide (Texas Hold 'Em, for instance) provide players with the option to, among other choices, fold after each deal. To fold is to discard one's hand, effectively losing the hand and any wagers made up to that point.

Some newer poker table games are played by pitting each player against a dealer (i.e., the "house"). In particular, the following prior art refers to certain hands being automatically disqualified, as opposed to being voluntarily folded.

U.S. Pat. No. 4,836,553 (Suttle, et al.) and U.S. Pat. No. 5,685,774 (Webb) each disclose a poker game that requires the disqualification of the dealer if the dealer's hand does not equal or exceed a predetermined minimum ranking.

U.S. Pat. No. 7,661,678 (Snow) teaches a poker game that requires the disqualification of the dealer if the dealer's hand equals or exceeds a predetermined maximum ranking.

The patents referred to above provide dealer disqualification that is an integral part of the basic gameplay and the mathematical analysis supporting each game. The disqualifications are necessary to insure that the game will have a solid house advantage; however, players feel frustration if they were dealt a lucrative or promising hand that they then cannot play out for potential large awards.

U.S. Pat. No. 5,782,473 (Chou, et al.) provides a card game in which each player is dealt five cards. After determining points perceived on his hand, each player must show three cards from his hand which add up to either ten, twenty, or thirty to continue playing the game. If a player cannot successfully do that, he is disqualified and must leave the game and wait for the next round. There is no upside to the player disqualification; that is, the player is not rewarded with additional player-friendly features (i.e., features that increase the expected value of the player's hand) that may offset the negativity of disqualification.

The advent of video technology has allowed poker games to be played not against other players but against a paytable that determines wins and losses. These games are described as "video poker".

Typically, video poker is played with a hand of five card draw poker that is dealt from a standard deck of 52 cards. The player chooses to hold none, some or all of the dealt cards. Any non-held cards are discarded, and replacement cards from the remaining deck of 47 cards are provided. The final hand is evaluated for any winning combinations, and paid according to a predetermined paytable.

Various video poker variations have been invented that have added additional excitement, anticipation and volatility, thereby increasing player participation. This is important to any gaming establishment. Since in virtually every gambling game there is a house advantage (that is, the player will play the game at less than a 100% payout), it is advantageous for the casino to draw in players to the machine and keep them playing.

Various prior art provide a multiplier bonus feature that preferably requires an extra wager in addition to the base wager. Many players, however, are reluctant to make an additional wager, since the additional wager can be as high as the base wager, with the payouts based on only the base wager. When making an extra wager, it is common for a player to receive an initial hand of Jacks or Better (paying 1 for 1) or Two Pair (paying 1 for 1), and still not get back the total wager.

U.S. Pat. No. 8,152,616 (Moody) teaches a payline multiplier that, for each activated payline, is randomly selected from a group of various multipliers and the selected multiplier is assigned to the activated payline. U.S. Pat. No. 7,247,092 (Jarvis et al.) discloses the use of one or more multiplier cards added to a conventional deck of playing cards. Whenever a multiplier card appears during the play of a video poker game, the payout for any winning combination that is achieved is multiplied by the value of the multiplier card. U.S. Pat. No. 8,550,892 (Moody) discusses a casino game wherein if the first initial hand comprises a predetermined arrangement of cards, a multiplier is randomly selected from a group of various multipliers for each activated payline. United States Patent Application No. 20100081498 (Moody) discusses a casino game wherein if the player achieves a winning outcome on the first round of play, the payouts for the next round of play of the casino game will be increased, based on the category of the winning outcome on the first round of play. The aforementioned multiplier patents disclose playing out all activated hands (whether or not the initial hand is a strong or potentially strong hand), and may include receiving a multiplier on a weak initial hand (thereby increasing the chances of multiplying a losing hand, and receiving no pay) or not receiving a multiplier on a promising hand (4-to-a-Flush, for instance). It is especially discouraging to a player when he finally achieves activation of a multiplier, only to be dealt a poor hand that has a small likelihood of converting into a winning hand. In addition, an extra wager is required to activate the multiplier feature; otherwise, the paytable would have to be adjusted lower in order to accommodate the increased payouts that would come from the multiplier feature.

Various other prior art provide other particular bonus features.

U.S. Pat. No. 7,316,608 (Moody) describes a wagering game wherein whenever the player achieves one of the predetermined types of starting hand combinations on the original round of play of the hand of video poker, then the player is awarded one or more additional hands of video poker on the next round of play. An extra wager is required to activate the bonus feature; otherwise, the paytable would have to be adjusted lower in order to accommodate the increased payouts that would come from the extra hands feature.

U.S. Pat. No. 6,045,129 (Cooper, et al.) describes a video poker game in which the player is offered the opportunity to replay the initial five-card hand. The player must make a separate wager each time the player wishes to replay the initial five-card hand.

Each of the references discussed in this text art are incorporated herein in their entirety for all purposes.

It is an ever-increasing challenge to provide players with new and enticing gameplay features that will stimulate player interest and increase time at the machine. It would be advantageous to provide a video poker game that provides bonus features at no extra wagers, with no lower adjustment to the basic paytable, and with the bonus features being offered primarily on more promising or payable initial hands.

SUMMARY OF THE INVENTION

The present invention provides a method of offering bonus features in video poker games without requiring an extra wager in addition to a base wager, and without lowering the paytable. In known prior art, the monies from an extra wager provide various bonus features while still assuring a house advantage. In lieu of wagering extra monies, the method of the present invention disqualifies a predetermined set of dealt hands (herein called "initial hands"), effectively ending the game and losing the wager. All initial hands that have not been disqualified are qualified hands that remain in play, and are herein referred to as active hands. The player is eligible to receive at least one randomly-provided bonus feature or guaranteed bonus feature on every active hand.

The particular composition of the predetermined set of disqualified initial hands will determine an additional house advantage percentage (over and above the house advantage inherent in the paytable) that may determine the configuration of the bonus feature(s). That is, a high additional house advantage may provide more lucrative and/or frequent bonus features; a low additional house advantage may provide less lucrative and/or frequent bonus features.

DETAILED DESCRIPTION OF THE INVENTION

Figure 1:
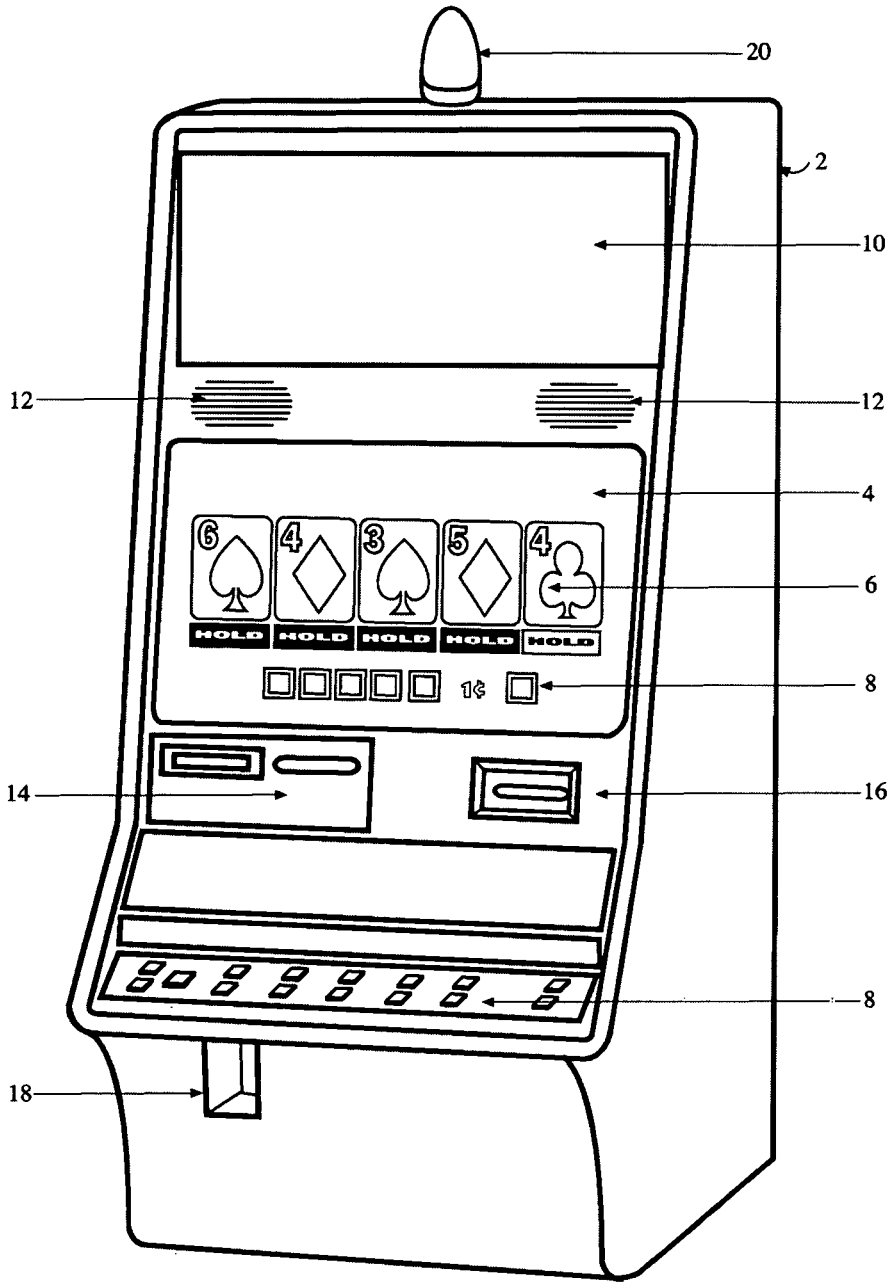
FIG. 1 shows a first gaming device capable of executing the present invention.

A method of playing an electronic card game uses one deck of 52 standard playing cards having 13 ranks (2, 3, 4, 5, 6, 7, 8, 9, 10, J, Q, K, A) and 4 suits (Hearts, Diamonds, Spades, Clubs). Alternately the deck may contain additional cards such as Jokers or Wild Cards. The game is played utilizing at least a computer processor, input device and a video monitor screen. The game may be played on at least a casino gaming machine, a personal computer or pad, an internet gaming site, or as a mobile application.

The card game is basically a 5-card draw poker game, modified to include at least one bonus feature that provides an extra excitement and anticipation not seen in traditional draw poker. Alternately, the card game may be a 3-, 4-, 6-, or 7-card game. The game may consist of one hand of poker, or multiple hands of poker played simultaneously. The single-hand game begins with the processor recognizing a wager of cash, credits or non-monetary points in order to play the game. After the wager is made, a hand of 5-card draw poker is dealt from a standard deck of 52 cards. The player chooses to hold none, some or all of the dealt cards. Any non-held cards are discarded, and replacement cards from the remaining deck of 47 cards are provided. The final hand is evaluated for any winning combinations, and paid according to a predetermined paytable. The multiple-hand game begins with the processor recognizing a wager of cash, credits or non-monetary points in order to play each hand in the game. After the wager is made, a hand of 5-card draw poker is dealt from a standard deck of 52 cards. The player chooses to hold none, some or all of the dealt cards. Any held cards are replicated in each wagered hand. Any non-held cards are discarded, and replacement cards from the remaining deck of 47 cards are provided for each wagered hand. The final hands are evaluated for any winning combinations, and paid according to a predetermined paytable.

An extra wager in addition to the base wager is not required in order to provide an eligibility of receiving an at least one special function (herein called "bonus feature") for the game, although a maximum base wager may be preferred. Traditionally, an extra wager in addition to the base wager (for example, 1 credit in addition to 5 credits, or 6 credits total) is required in order to be provided with a bonus feature, with any wins based on the base wager paytable and not the total wager. Due to the house advantage, casinos are inclined to favor games with higher wagers; however, the present invention can still provide higher wagers by allowing higher base wagers. For instance, a player may be able to choose a base wager of 5 credits, 10 credits, 15 credits, 20 credits or 25 credits per hand with the paytable being based on 5 credits, 10 credits, 15 credits, 20 credits or 25 credits, respectively. Each of the aforementioned base wagers may be considered a maximum bet, therefore providing the eligibility of receiving an at least one bonus feature for the game if a maximum bet is required.

The bonus feature may become randomly activated in the course of play of an active hand. Alternately, the bonus feature may be provided not randomly, but on every X amount of active hands, an average of every X amount of active hands, or on every active hand. The bonus feature is preferably activated after the deal of the initial hand, after the choice to hold none, any, or all of the dealt cards, after the player has locked in his choice, or after the hand has been evaluated for wins.

The rules of the game require that a predetermined set of initial hands must be disqualified; that is, the initial hands are forfeited along with the wager, thereby providing an automatic loss and ending the play of the hand. Predetermined exceptions to the predetermined set of initial hands may be offered. The particular composition of the predetermined set of disqualified initial hands determines an expected value that provides an additional house advantage (over and above the house advantage inherent in the paytable) that may determine the configuration of the bonus feature(s). That is, a high additional house advantage may provide more lucrative and/or frequent bonus features; a low additional house advantage may provide less lucrative and/or frequent bonus features.

In games requiring a predetermined extra wager in order to be eligible for the bonus feature, the player knows exactly how much extra he is wagering on each hand, and this extra amount does not vary from hand to hand. Every hand is costing the player the exact value of the extra wager plus the base wager. In the present invention, however, the player is not privy to the exact cost of every individual hand, as only the expected value and not the actual value of the disqualified hand is known. The expected value of a particular hand is the amount of money that the player will win on average on the wager. The expected value may be referred to as "positive", meaning that the expected value is higher than the amount of the wager, or "negative", meaning that the expected value is lower than the amount of the wager. Every disqualified initial hand loses not only the base wager, but its expected value. For instance, if a disqualified initial hand comprises the 6 of Spades, the Queen of Diamonds, the 5 of Spades, the 5 of Diamonds, and the 4 of Clubs, and if the player could have played it out with holding just the two 5s, the final hand could possibly have ended up being (besides a losing hand) Two Pair, 3-of-a-Kind, Full House, or 4-of-a-Kind. Therefore by not playing out this said disqualified hand, and according to the sample paytable in FIG. 3A, the player loses out on nothing more than the base wager if he had ended up with a losing final hand, he loses out on 5 credits (plus the base wager) if the final hand had been 2 Pairs, he loses out on 15 credits (plus the base wager) if the final hand had been a 3-of-a-Kind, he loses out on 40 credits (plus the base wager) if the final hand had been a Full House, or he loses out on 250 credits (plus the base wager) if the final hand had been a 4-of-a-Kind. The expected value of each disqualified initial hand and the frequency of its occurrence are used to figure the additional house advantage that may determine the configuration of the bonus feature. If the player is dealt a fewer than average amount of disqualified initial hands, he will be playing at a lower additional house advantage. If the player is dealt a more than average amount of disqualified initial hands, he will be playing at a higher additional house advantage. This makes the game less predictable, and therefore more exciting.

In a first embodiment of the present invention, the predetermined set of initial hands that require disqualification comprises hands that have a negative expected value. In particular, all non-paying hands (hands that do not include at least a pair of Jacks) comprising five cards of all mixed rank comprise the predetermined set of dealt hands. Initial hands of all mixed rank with no high cards are traditionally called "garbage"; that is, no cards are held, and the hand has a low probability of converting into a paying hand upon the draw. The initial hands of all mixed rank may instead contain a single or multiple mixed high cards. These hands too have a negative expected value. It is well known that players are discouraged when they are dealt either of these said initial hands, since in the long run, they will be losing propositions. The present invention provides automatic disqualification for these less than promising hands. All initial hands that have not been disqualified are qualified hands. Every said qualified hand remains in play as an active hand, and the player is eligible to receive at least one randomly-provided bonus feature or guaranteed bonus feature on every active hand. Because the disqualified hands are generally negative expected value hands, the remaining active hands overall have a higher expected value, so the player is afforded the bonus feature on more promising hands.

There may be exceptions to the hands comprising the predetermined set of initial hands. In a second embodiment of the present invention, the predetermined set of initial hands as described in the first embodiment of the present invention is narrowed by excluding certain predetermined hands. Exclusions may comprise any initial hand that includes, but is not limited to, at least one of the following: at least a single Ace, at least two cards to a Royal Flush, at least three cards to a Straight Flush, at least four cards to a Straight (inside and/or outside), and at least four cards to a Flush.

In a third embodiment of the present invention, the predetermined set of initial hands as described in the first embodiment of the present invention may include additional hands that are disqualified. These additional hands may, for example, comprise any one particular small pair (two 7s, for instance) plus three mixed ranks or one pair of a specific set of small pairs (two 5s through two 9s, for instance) plus three mixed ranks. Exclusions to the predetermined set of initial hands in this third embodiment may include, but is not limited to, at least one of the following: at least a single Ace, at least two cards to a Royal Flush, at least three cards to a Straight Flush, at least four cards to a Straight (inside and/or outside), and at least four cards to a Flush.

It should be appreciated that the particular design and mathematical analysis of the game will dictate both the final composition of the predetermined set of initial hands (i.e., the predetermined set minus any exclusions) that must be disqualified and the configuration of the bonus feature. Various bonus features may include, but are not limited to:

Multipliers

- A random multiplier may be applied to every active hand; the multiplier may or not be the same for each active hand in a multiple hand format.
- A random multiplier may be applied to every active hand if the multiplier feature has been randomly activated; the multiplier may or not be the same for any of each active hand in a multiple hand format.
- A predetermined multiplier may be applied to every active hand.
- A predetermined multiplier may be applied to every active hand if the multiplier feature has been randomly activated.
- A random multiplier may be applied to at least one active hand in a multiple hand format; the multiplier may or not be the same for any of each active hand that receives the multiplier application.

A random multiplier may be applied to at least one active hand in a multiple hand format if the multiplier feature has been randomly activated; the multiplier may or not be the same for any of each active hand that receives the multiplier application.

A predetermined multiplier may be applied to at least one active hand.

A predetermined multiplier may be applied to at least one active hand if the multiplier feature has been randomly activated.

A random multiplier may be applied to certain predetermined final hand winning outcomes.

A predetermined multiplier may be applied to certain predetermined final hand winning outcomes.

A random multiplier may be applied to certain predetermined final hand winning outcomes if the multiplier feature has been randomly activated.

A predetermined multiplier may be applied to certain predetermined final hand winning outcomes if the multiplier feature has been randomly activated.

Wild Cards

At least one wild card (a joker, for instance) may be added to the replacement deck for every active hand.

At least one wild card (a joker, for instance) may be added to the replacement deck for every active hand if the wild card feature has been randomly activated.

At least one wild card (a joker, for instance) may be added to the replacement deck for at least one active hand.

At least one wild card (a joker, for instance) may be added to the replacement deck for at least one active hand if the wild card feature has been randomly activated.

Extra Hands

At least one extra hand may be provided at no extra cost in addition to the active wagered hand(s).

At least one extra hand may be provided at no extra cost in addition to the active wagered hand(s) if the extra hand feature has been randomly activated.

Replay Hands

Every active initial hand may be replayed one time at no extra cost. The player may or may not replay the hand in the same fashion as the initial play.

Every active initial hand may be replayed more than one time at no extra cost. The player may or may not replay the hand in the same fashion as the initial play.

The active initial hand may be replayed one time at no extra cost if the replay feature has been randomly activated. The player may or may not replay the hand in the same fashion as the initial play.

The active initial hand may be replayed more than one time at no extra cost if the replay feature has been activated. The player may or may not replay the hand in the same fashion as the initial play.

Enhanced Paytable

The paytable may be enhanced on all active hands.

The paytable may be enhanced on all active hands if the bonus feature has been randomly activated.

The paytable may be enhanced on at least one active hand.

The paytable may be enhanced on at least one active hand if the bonus feature has been randomly activated.

Extra Credits

A random amount of extra credits may be provided on every active hand; the amount of extra credits may or not be the same for any of each active hand in a multiple hand format.

A random amount of extra credits may be provided on every active hand if the bonus feature has been randomly activated. The amount of extra credits may or not be the same for any of each active hand in a multiple hand format.

A predetermined amount of extra credits may be provided on every active hand.

A predetermined amount of extra credits may be provided on every active hand if the bonus feature has been randomly activated.

A random amount of extra credits may be provided on at least one active hand; the amount of extra credits may or not be the same for any of each active hand that receives the extra credit application in a multiple hand format.

A random amount of extra credits may be provided on at least one active hand if the bonus feature has been randomly activated. The amount of extra credits may or not be the same for any of each active hand that receives the extra credit application in a multiple hand format.

A predetermined amount of extra credits may be provided on at least one active hand.

A predetermined amount of extra credits may be provided on at least one active hand if the bonus feature has been randomly activated.

Player Points

A random amount of player points may be provided on every active hand; the amount of player points may or not be the same for any of each active hand in a multiple hand format.

A random amount of player points may be provided on every active hand if the bonus feature has been randomly activated. The amount of player points may or not be the same for any of each active hand in a multiple hand format.

A predetermined amount of player points may be provided on every active hand.

A predetermined amount of player points may be provided on every active hand if the bonus feature has been randomly activated.

A random amount of player points may be provided on at least one active hand; the amount of player points may or not be the same for any of each active hand that receives the player points application in a multiple hand format.

A random amount of player points may be provided on at least one active hand if the bonus feature has been randomly activated. The amount of player points may or not be the same for any of each active hand that receives the player points application in a multiple hand format.

A predetermined amount of player points may be provided on at least one active hand.

A predetermined amount of player points may be provided on at least one active hand if the bonus feature has been randomly activated.

Free Play

A random amount of free play games may be provided if the bonus feature has been randomly activated.

A predetermined amount of free play games may be provided if the bonus feature has been randomly activated.

A random amount of free play games with a random multiplier may be provided if the bonus feature has been randomly activated.

A random amount of free play games with a predetermined multiplier may be provided if the bonus feature has been randomly activated.

A predetermined amount of free play games with a random multiplier may be provided if the bonus feature has been randomly activated.

A predetermined amount of free play games with a predetermined multiplier may be provided if the bonus feature has been randomly activated.

Bonus Games

A bonus game may be provided for every active initial hand; the bonus game may or may not be the same as the underlining base poker game.

A bonus game may be randomly provided for every active initial hand; the bonus game may or may not be the same as the underlining base poker game.

Reference to the Figures will assist in further understanding of the practice of the present invention.

FIG. 1 illustrates a gaming machine that includes at least a cabinet 2 and monitor screen 4 capable of displaying a video gambling game 6. The video gambling game comprises at least a symbol game and touchscreen buttons or physical buttons 8 that enable a player to play the video wagering game. An additional video monitor screen 10 may be provided, upon which individual game symbols may be displayed. The gaming machine or apparatus preferably also includes speakers 12, and a value input/output device 14 that allows a player to insert value for game play or extract value of said game play. A separate device 16 is provided that preferably enables a player card or ticket to be inserted for the purpose of keeping track of player information, providing information of benefits or events, and the like. In rarer or older examples, a coin output device 18 may be provided. An electronic signaling device 20 may be apportioned on the top of the gaming machine to signal information of wins or needs to the appropriate people or employees.

Figure 2:
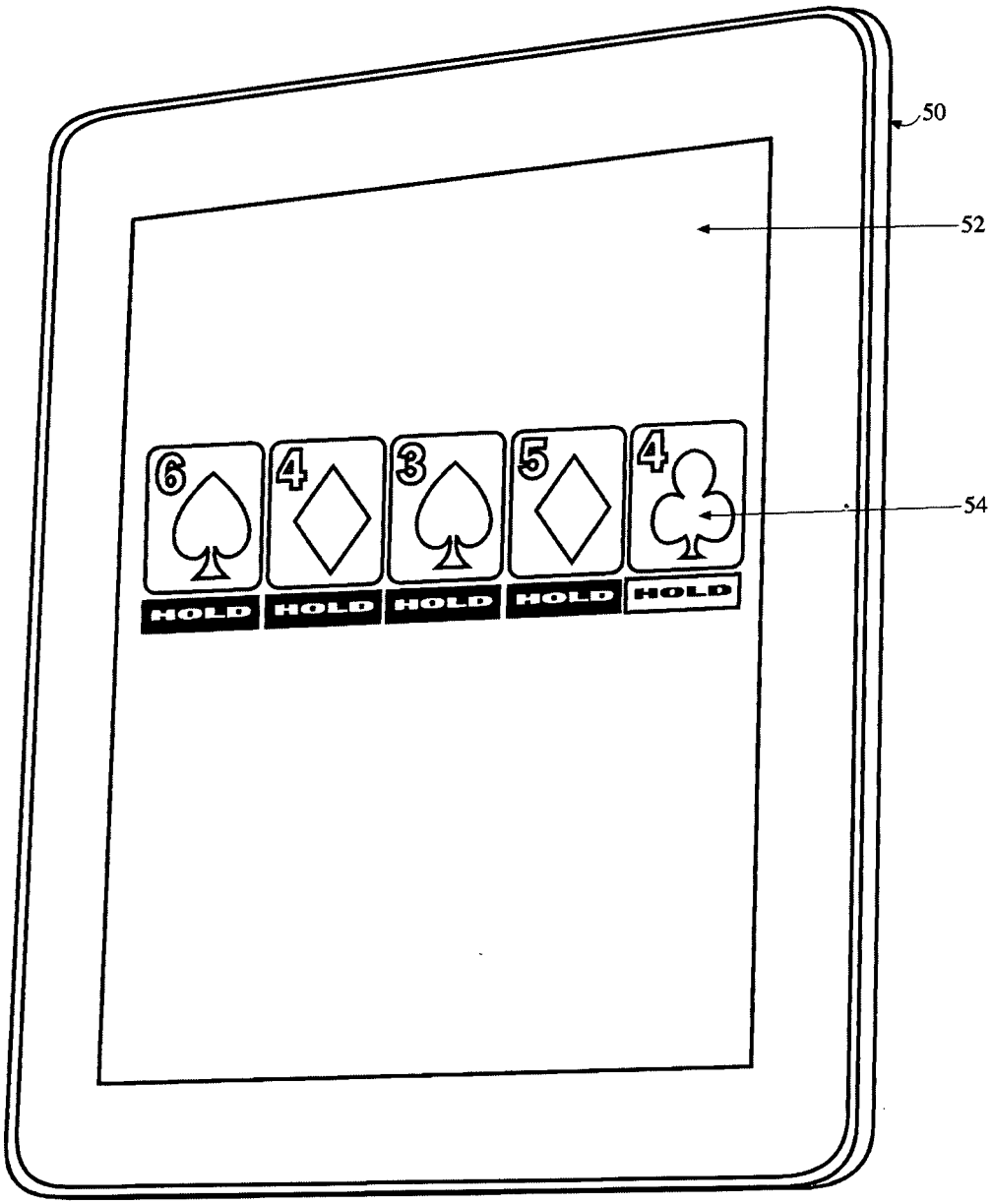
FIG. 2 shows an example of a second device capable of executing the present invention.

FIG. 2 illustrates an alternate device 50 capable of displaying and playing a video wagering game 54 on a screen monitor 52. The said devices may include at least a desktop computer, a laptop computer, an iPad®-like device, or an iPhone®-like device.

Figure 3A:
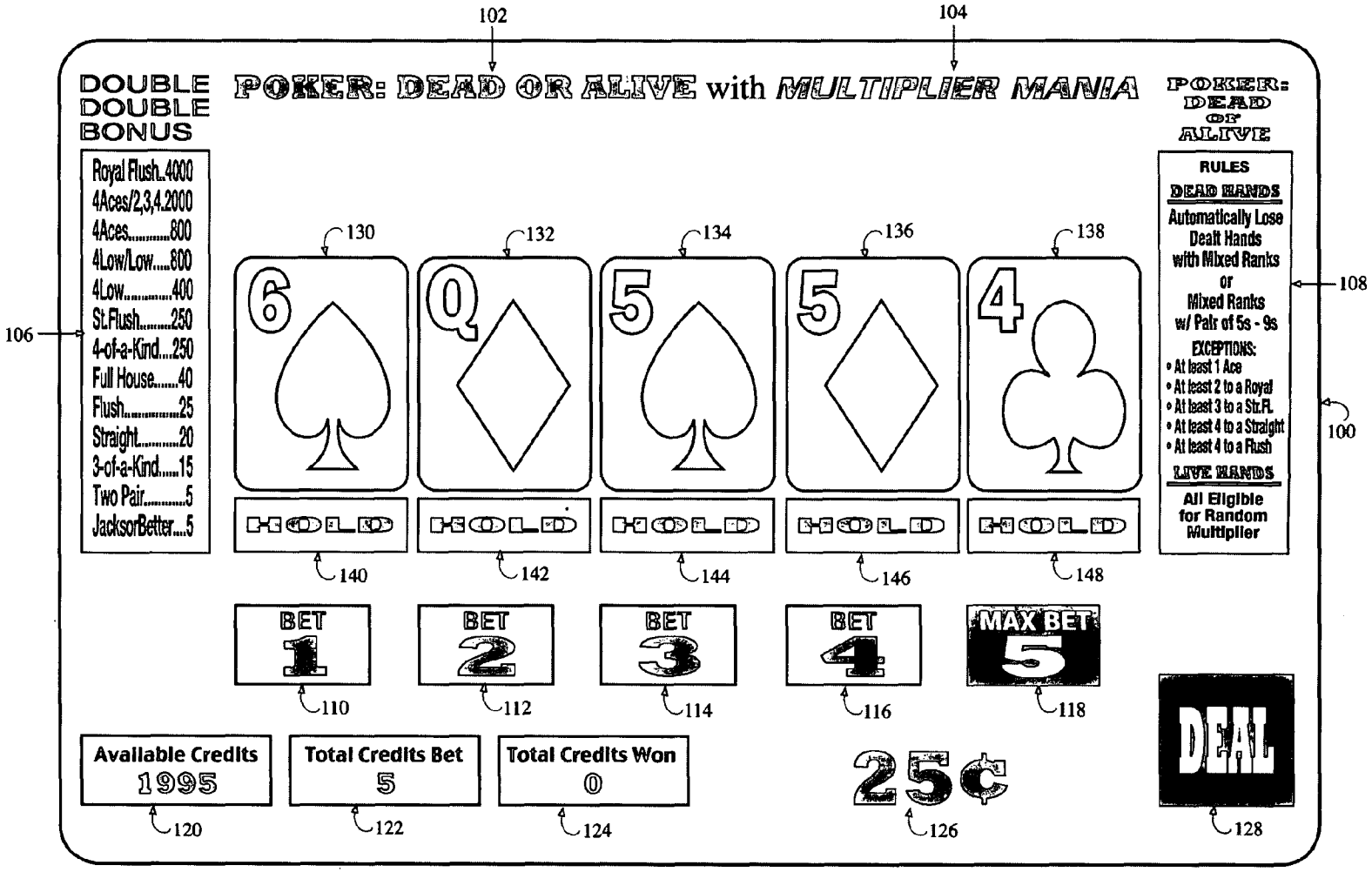
FIG. 3A shows an electronic screen utilizing the game technology described herein, and providing a first hand of a first game of the present technology.

FIG. 3A illustrates an electronic screen 100 depicting the basic elements of a first hand of a first game of the present invention. The game's name (herein called "Poker: Dead or Alive") 102 and the specific available bonus feature (herein called "Multiplier Mania") 104 are displayed on the screen 100. The Multiplier Mania feature randomly provides a random multiplier when the feature is activated. A sample paytable 106 and a rules table 108 are also displayed. The rules for this first game specify that the player will automatically lose initial (five-card) hands comprised of either all mixed ranks or all mixed ranks with a pair of 5s through 9s (herein called "DEAD" hands). Exceptions to these rules include initial hands that include at least one Ace, at least two cards to a Royal Flush, at least three cards to a Straight Flush, four cards to an (outside) Straight, or four cards to a Flush. All qualified initial hands (herein called "LIVE" hands) are eligible for the random multiplier bonus feature. Also shown are touchscreen buttons (110, 112, 114, 116, 118) that enable the player to bet or wager by pressing the button (activated buttons are shown highlighted in black). It should be appreciated that any touchscreen buttons may in fact be physical buttons. Windows are shown that display the player's Available Credits 120, Total Credits Bet 122, and Total Credit Won 124. The denomination of the game 126 is shown; in this example, the player is playing a 250 game. A Deal button 128 is shown; the same button is utilized as a Draw button. In this example, the player has activated the Max Bet button 118, betting 5 credits ($1.25). The Total Credits Bet 122 (5 credits) is shown, as is the player's Available Credits 120 (1995 credits). He then has activated the Deal button 128, receiving the five cards of the initial hand: the 6 of Spades 130, the Queen of Diamonds 132, the 5 of Spades 134, the 5 of Diamonds 136, and the 4 of Clubs 138. Five Hold buttons (140, 142, 144, 146, 148) that correspond to the five dealt cards are also shown.

Figure 3B:
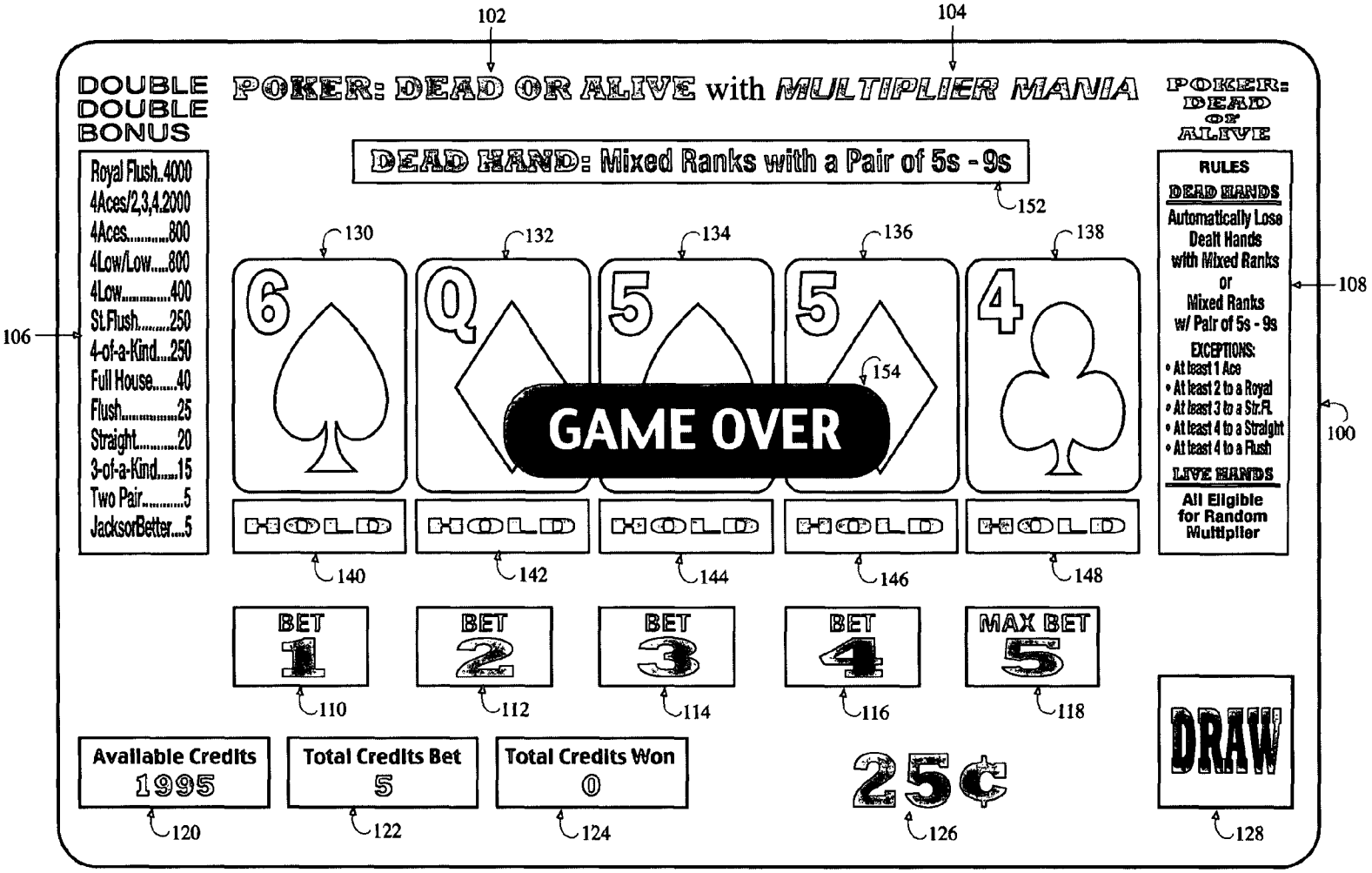
FIG. 3B shows the first hand of the first game of the present technology at a final resolution stage.

FIG. 3B refers to the elements in FIG. 3A, wherein the player's hand has been automatically disqualified; an information window 152 explains that the hand is "DEAD" because it is comprised of mixed ranks with a pair of 5s-9s. A Game Over box 154 is also displayed. (Note the Max Bet button 118 has been deactivated, and the Deal button 128 has changed to a Draw button.) The player automatically loses his $1.25 bet.

Figure 4A:
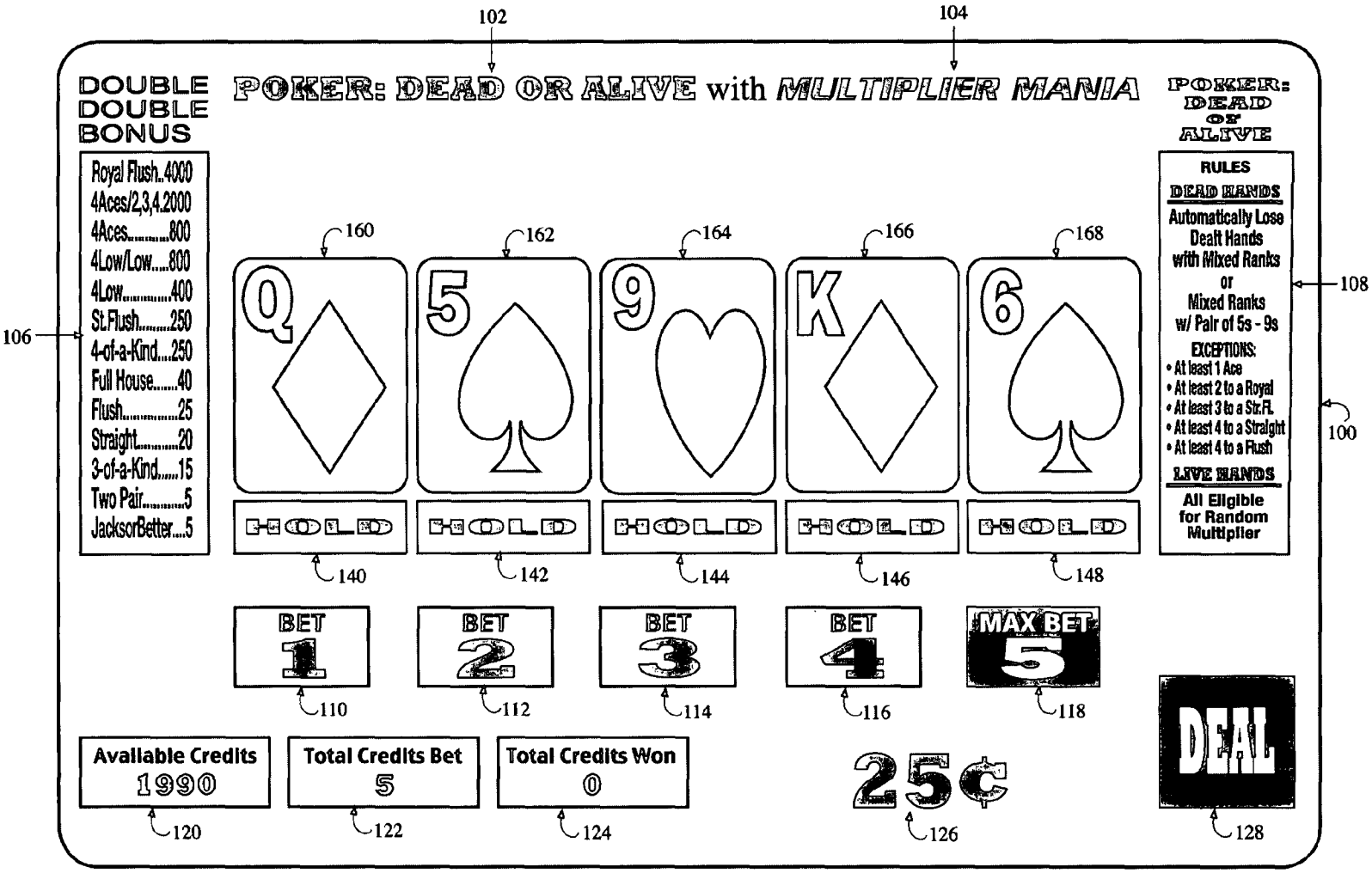
FIG. 4A shows a second hand of the first game of the present technology.

FIG. 4A shows a second hand of the first game and refers to the elements in FIG. 3A with the player again betting 5 credits as shown in the Total Credits Bet window 122. The Available Credits window 120 now displays 1990 credits. The initial hand is dealt, comprising the Queen of Diamonds 160, the 5 of Spades 162, the 9 of Hearts 164, the King of Diamonds 166, and the 6 of Spades 168.

Figure 4B:
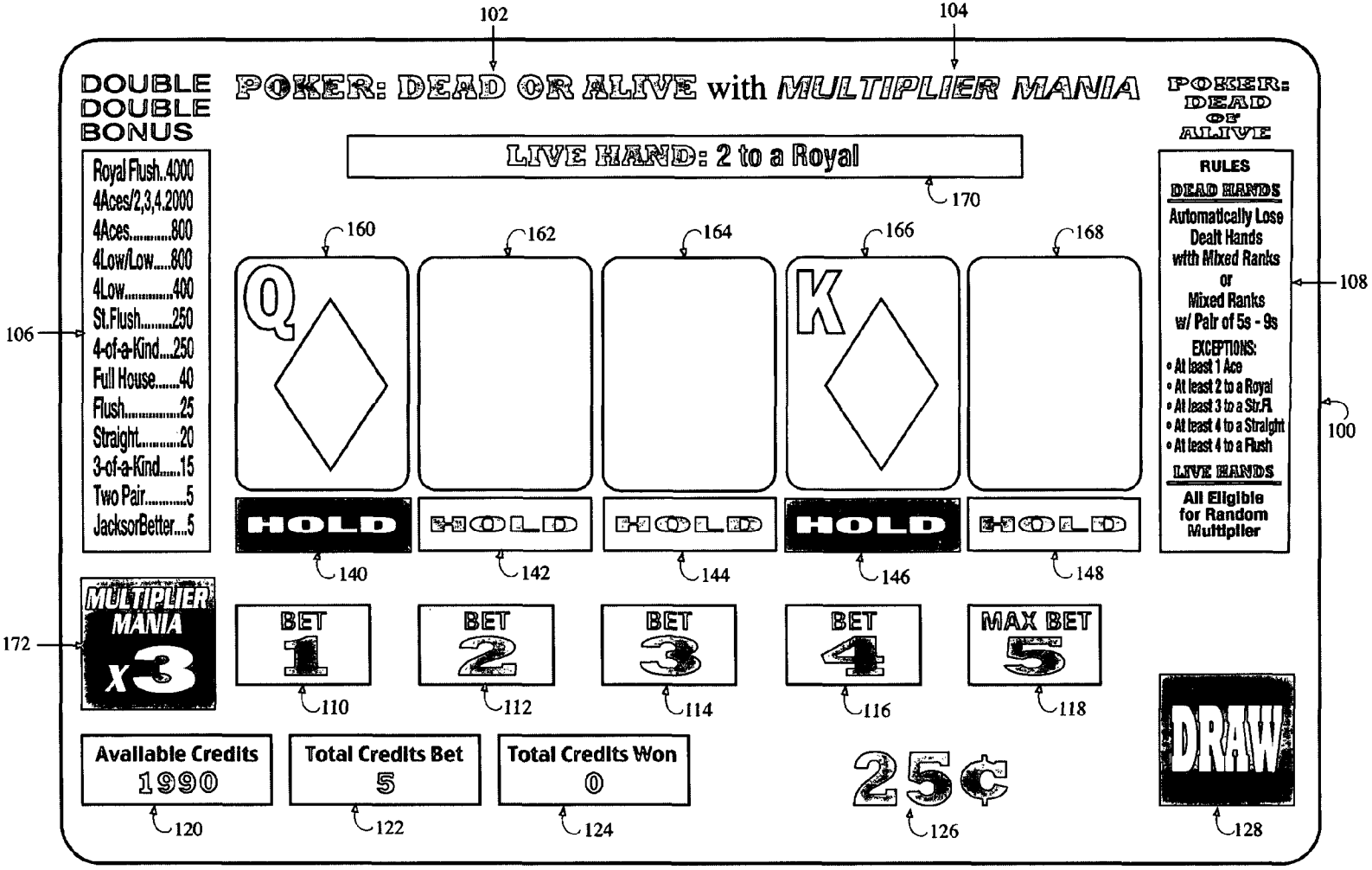
FIG. 4B shows the second hand of the first game at a later stage.

FIG. 4B refers to the elements in FIG. 4A, wherein an information window 170 is displayed that explains that the reason the hand is "LIVE" is because it contains two cards to a Royal Flush. The player is not obligated to select any specific cards for the final hand; that is, the cards in the initial hand (two cards to a Royal, in this case) that provide the reason for qualification do not necessarily have to be held for the final hand. The Multiplier Mania bonus feature 172 has randomly become activated for this hand, with a random multiplier (3× pay, in this case) being displayed. In this example, the player decides to hold the Queen of Diamonds and the King of Diamonds by activating the Hold buttons 140 and 146 and then activating the Draw button 128. The three unheld cards (162, 164, 168) have been discarded.

Figure 4C:
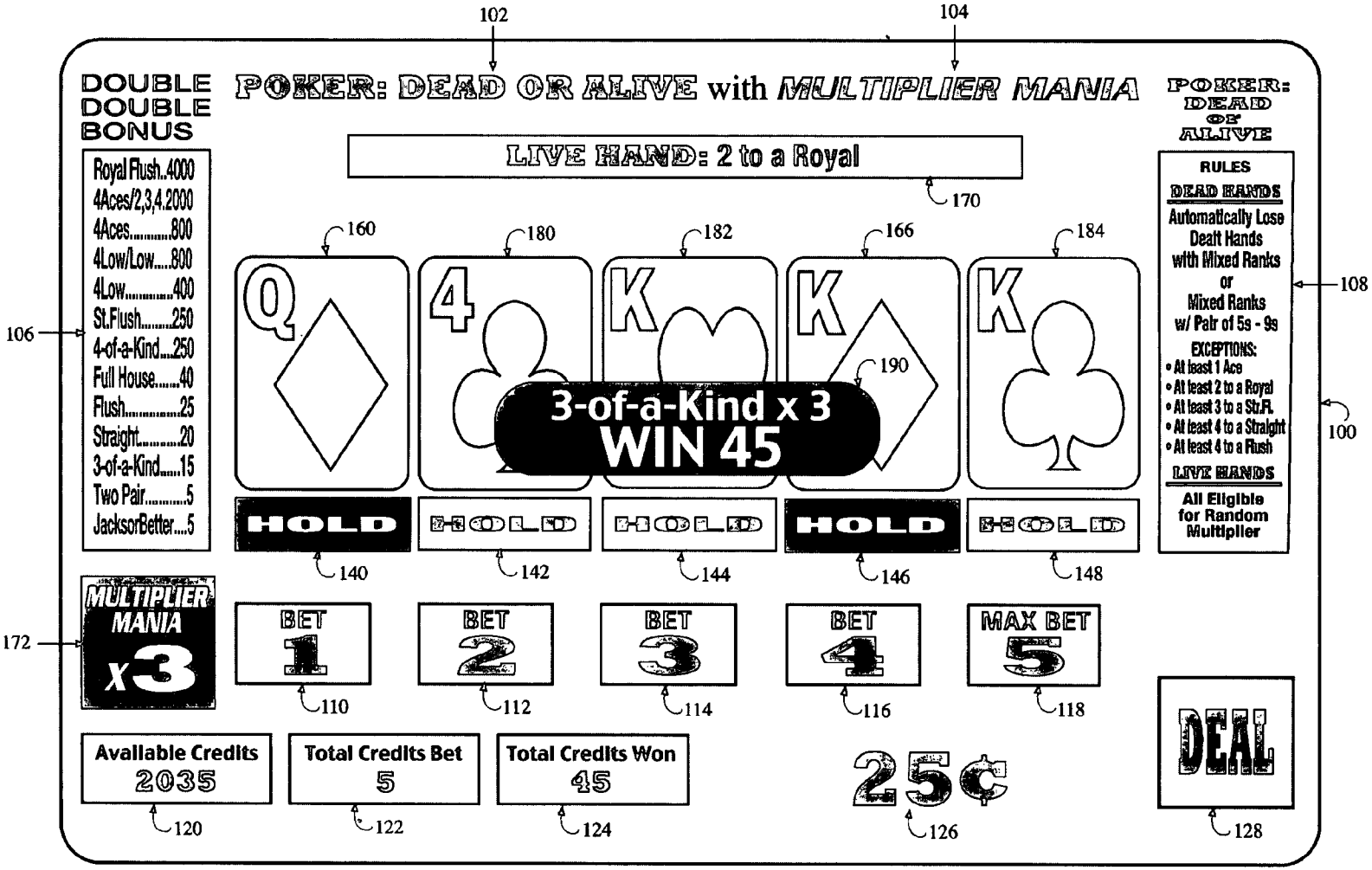
FIG. 4C shows the second hand of the first game at a final resolution stage.

FIG. 4C refers to the elements in FIG. 4B with the discarded cards being replaced by the 4 of Clubs 180, the King of Hearts 182, and the King of Clubs 184. The final hand is evaluated for wins, and the player is then notified that he has achieved a 3-of-a-Kind win multiplied by 3, as shown in the box 190. As per the paytable 106, the Total Credits Won 124 are now shown as 45 credits, and the Available Credits 120 are now shown as 2035 credits. The Draw button 128 has changed to a Deal button.

Figure 5A:
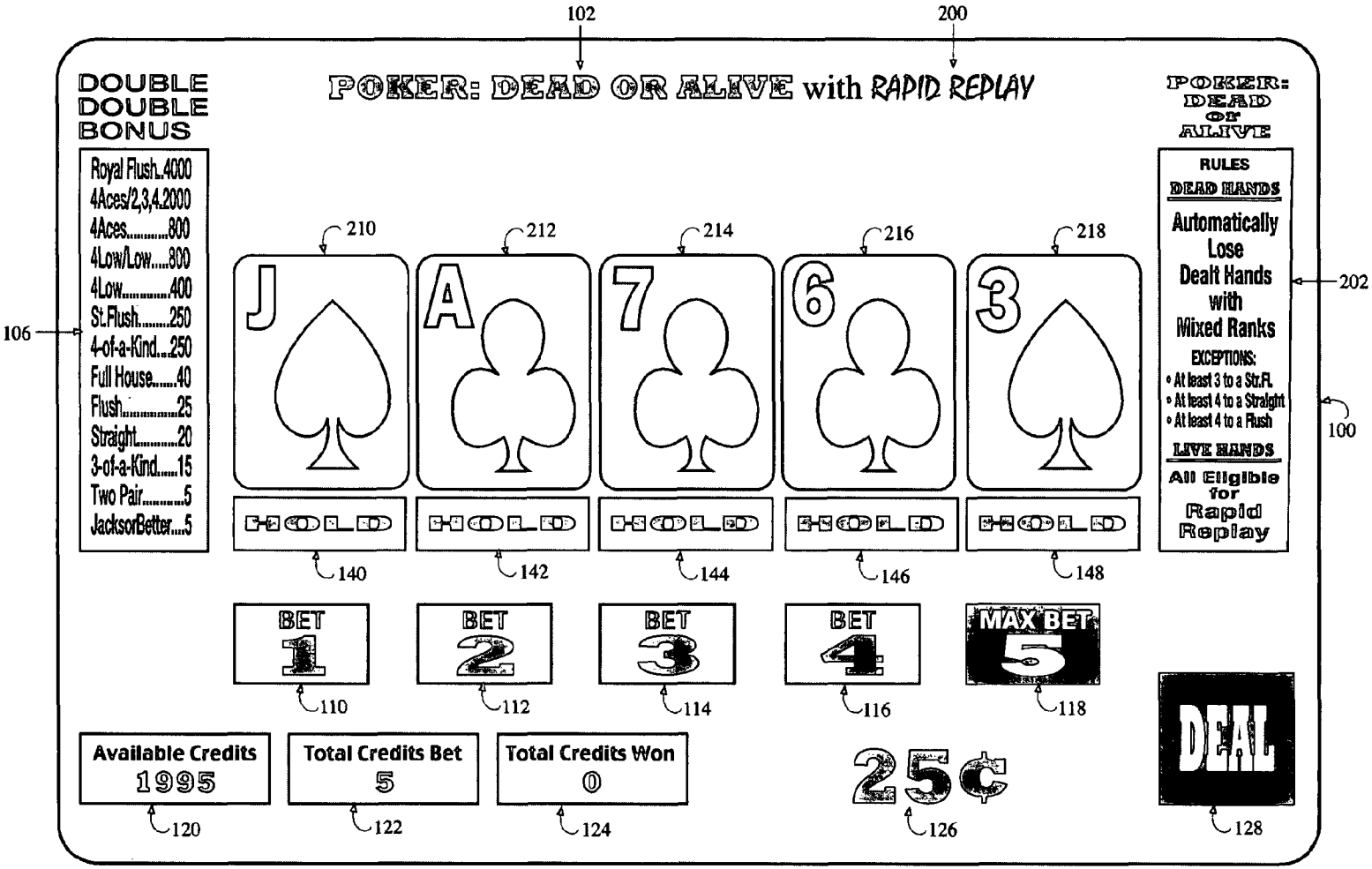
FIG. 5A shows a first hand of a second game of the present technology.

FIG. 5A shows a first hand of a second game of the present invention and refers to the basic gameplay elements as illustrated in FIG. 3A. In this second game, a different specific available bonus feature (herein called "Rapid Replay") 200 is displayed on the screen 100. The Rapid Replay feature allows a player to play the dealt hand again at no additional cost when the feature is activated. Also displayed is a different rules table 202. The rules for this second game specify that the player will automatically lose initial (five-card) hands comprised of all mixed ranks. Exceptions to these rules include initial hands that include at least three cards to a Straight Flush, four cards to an (outside) Straight, or four cards to a Flush. In this example, the player has activated the Max Bet button 118, betting 5 credits ($1.25). The Total Credits Bet 122 (5 credits) is shown, as is the player's Available Credits 120 (1995 credits). He then has activated the Deal button 128, receiving the five cards of the initial hand: the Jack of Spades 210, the Ace of Clubs 212, the 7 of Clubs 214, the 6 of Clubs 216, and the 3 of Spades 218.

Figure 5B:
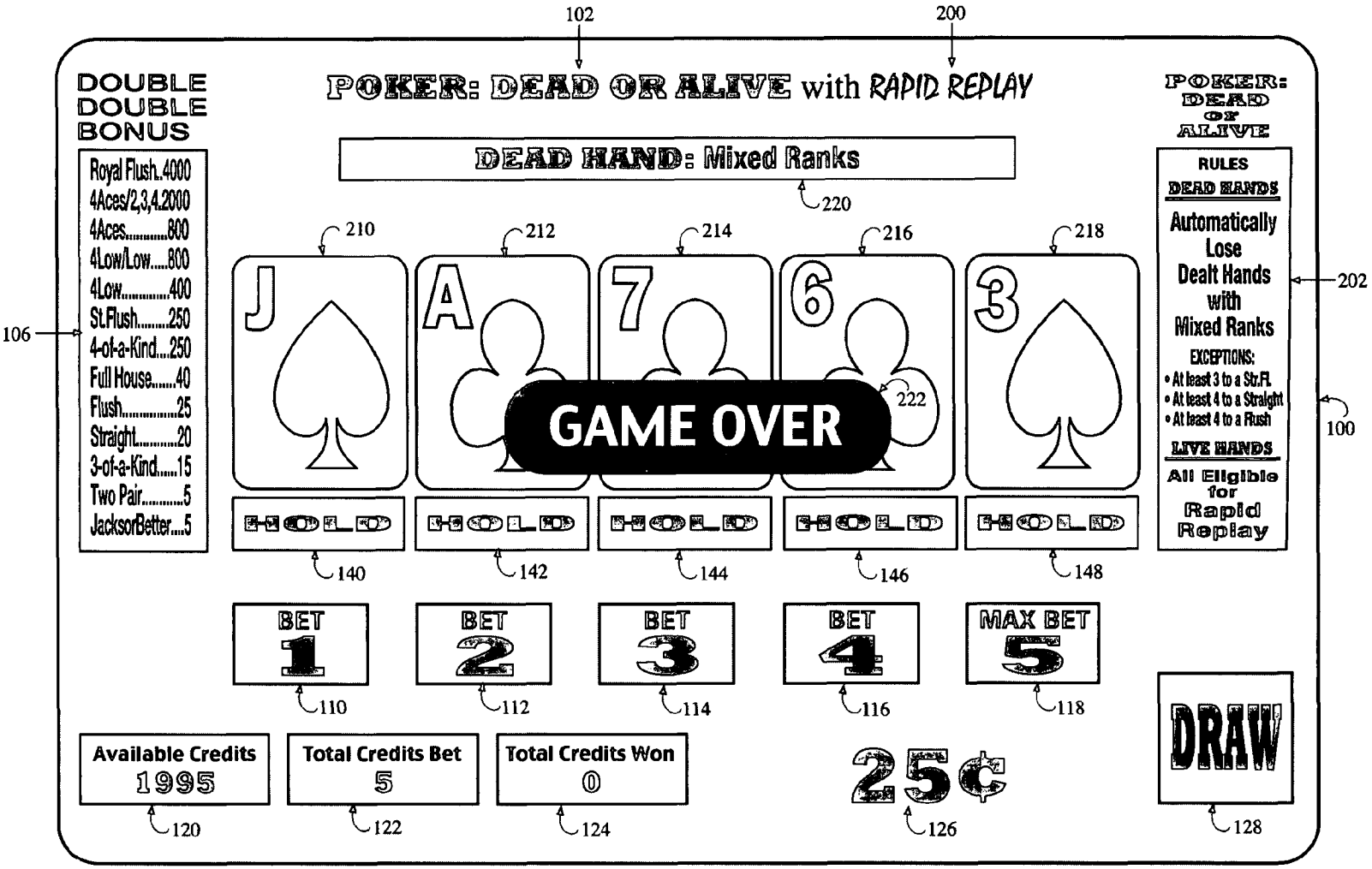
FIG. 5B shows the first hand of the second game at a final resolution stage.

FIG. 5B refers to the elements in FIG. 5A, wherein the player's hand has been automatically disqualified; an information window 220 explains that the hand is "DEAD" because it is comprised of mixed ranks. A Game Over box 222 is also displayed. (Note the Max Bet button 118 has been deactivated, and the Deal button 128 has changed to a Draw button.) The player automatically loses his $1.25 bet.

Figure 6A:
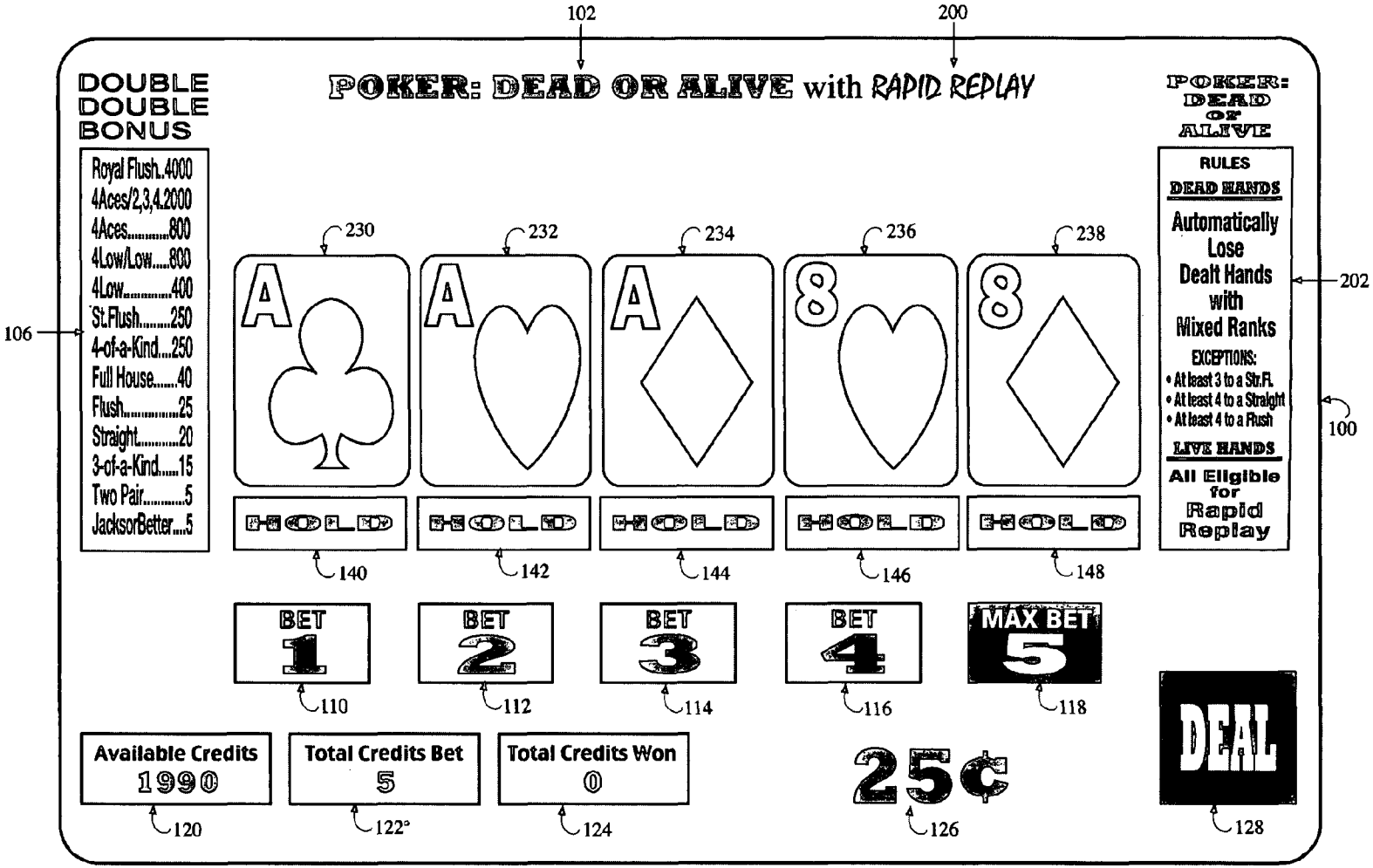
FIG. 6A shows a second hand of the second game of the present technology.

FIG. 6A shows a second hand of the second game and refers to the elements in FIG. 5A with the player again betting 5 credits 118 as shown in the Total Credits Bet window 122. The Available Credits window 120 now displays 1990 credits. He then has activated the Deal button 128, receiving the five cards of the initial hand: the Ace of Clubs 230, the Ace of Hearts 232, the Ace of Diamonds 234, the 8 of Hearts 236, and the 8 of Diamonds 238.

Figure 6B:
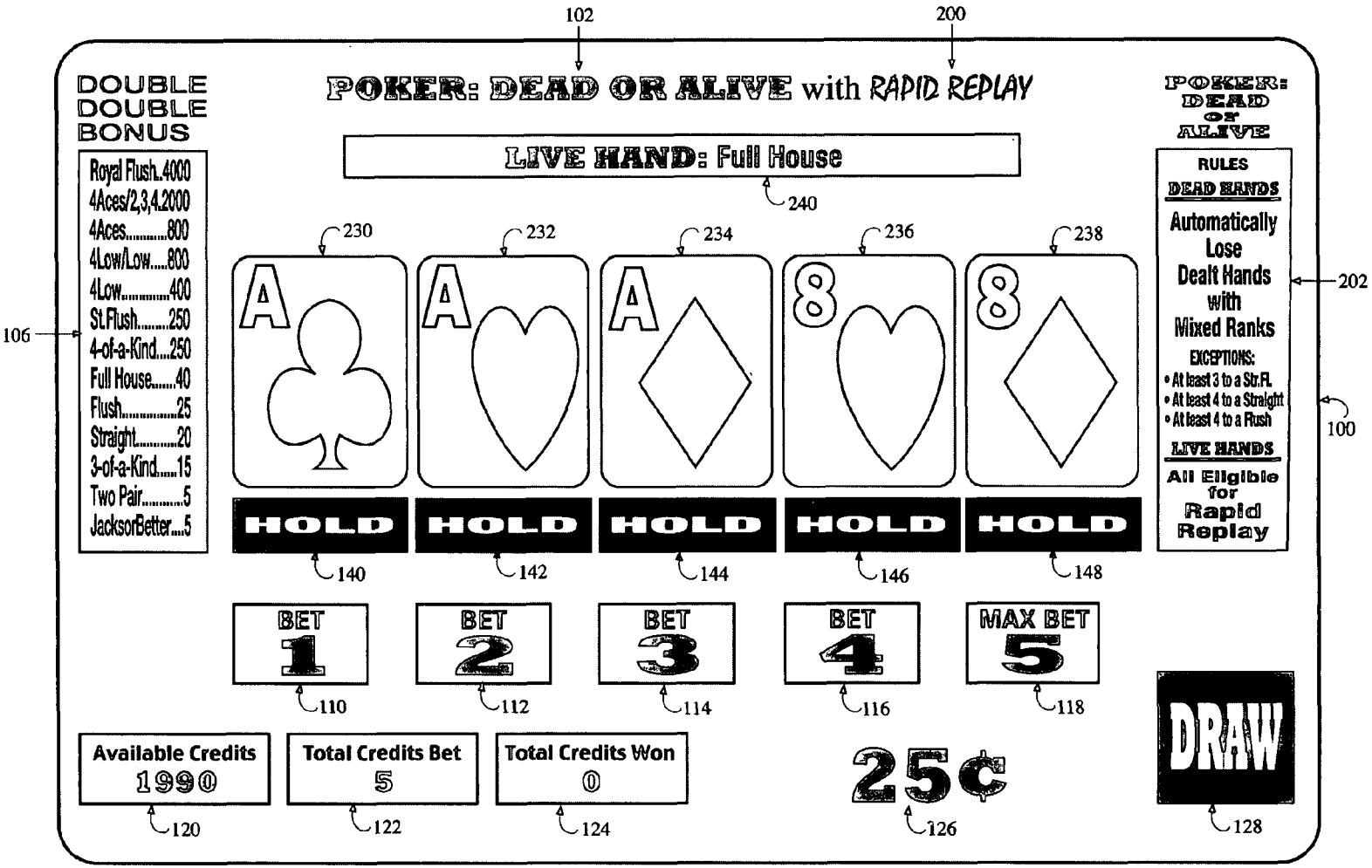
FIG. 6B shows the second hand of the second game at a later stage.

FIG. 6B refers to the elements in FIG. 6A, wherein an information window 240 is displayed that explains that the reason the hand is "LIVE" is because it contains a Full House. The player is not obligated to select any specific cards for the final hand; that is, the cards in the initial hand (a Full House, in this case) that provide the reason for qualification do not necessarily have to be held for the final hand. In this example, the player decides to hold all of the dealt cards by activating the Hold buttons (140, 142, 144, 146, 148). He then activates the Draw button 128. (Note the Max Bet button 118 has been deactivated.)

Figure 6C:
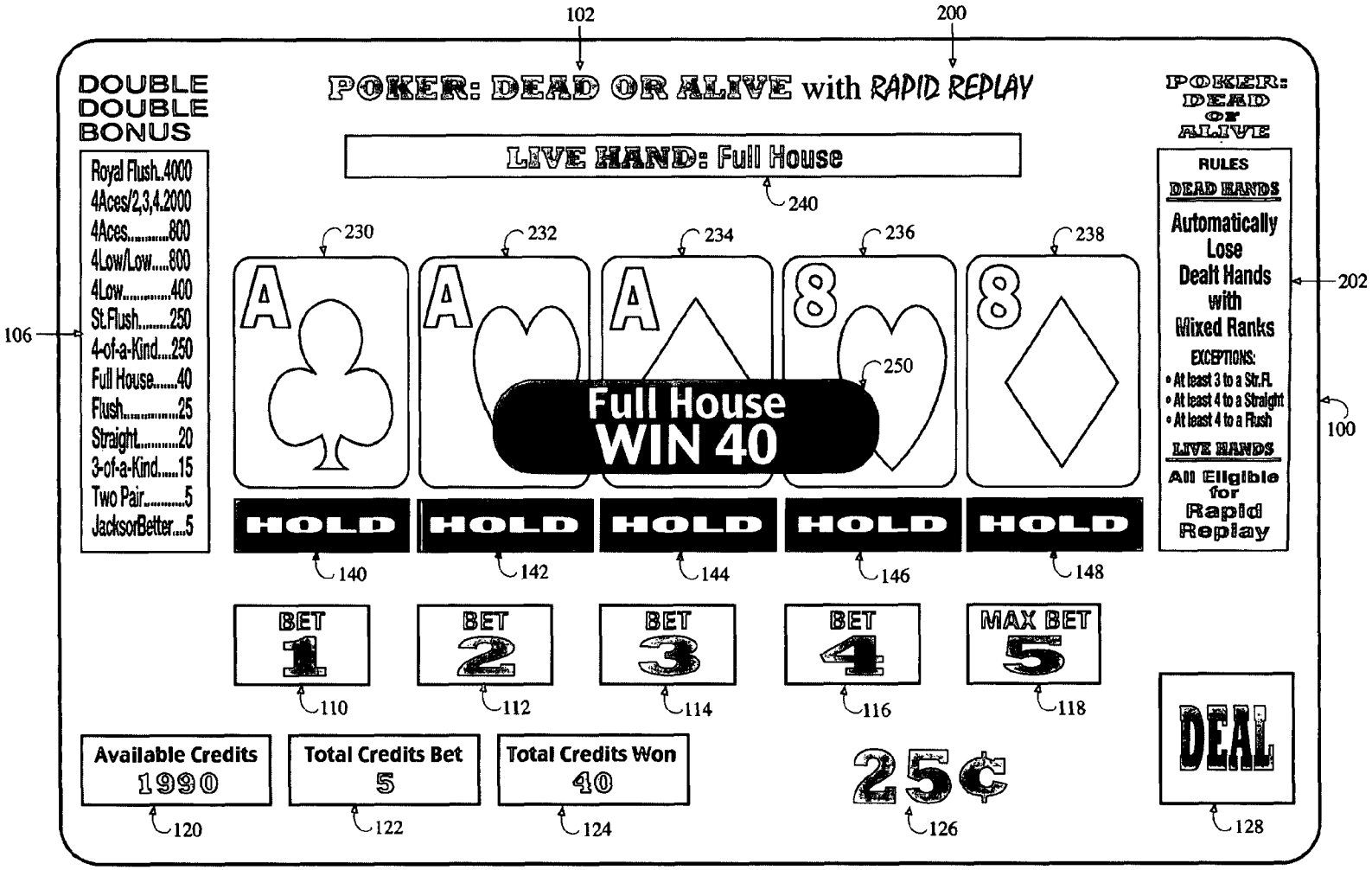
FIG. 6C shows the second hand of the second game at a later stage.

FIG. 6C refers to the elements in FIG. 6B with the final hand being evaluated for wins, and the player being notified that he has achieved a Full House win, as shown in the box 250. As per the paytable 106, the Total Credits Won 124 are now shown as 40 credits. (Note the Draw button 128 has changed to a Deal button.)

Figure 6D:
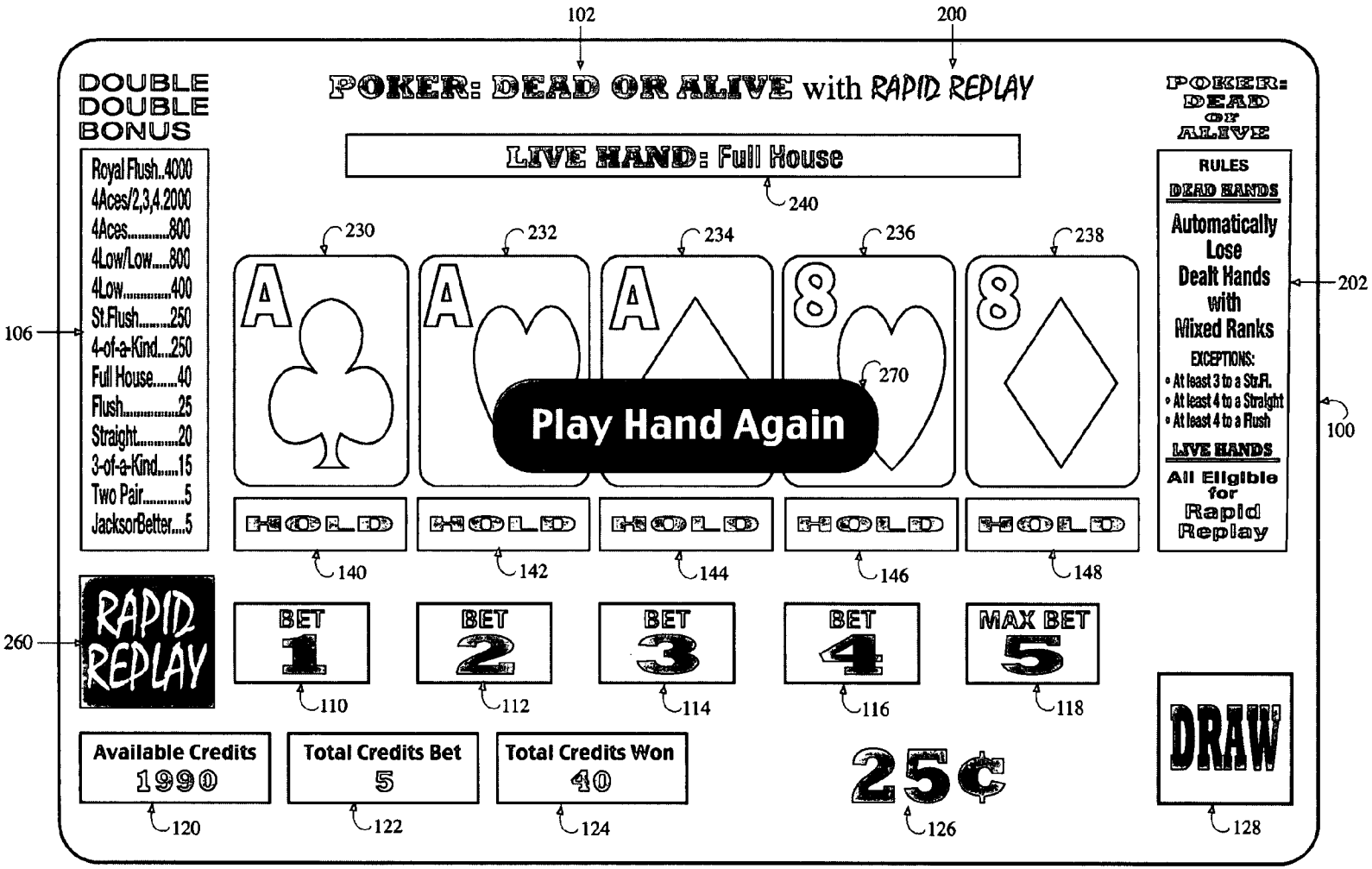
FIG. 6D shows the second hand of the second game at a later stage.

FIG. 6D refers to the elements in FIG. 6C wherein the Rapid Replay bonus feature 260 has randomly become activated immediately upon the final resolution of the first hand as described in FIG. 6C. A box 270 is displayed that informs the player to play the hand again. (Note the Max Bet button 118 is not activated since this is a free hand, and the Deal button 128 has changed to a Draw button.)

Figure 6E:
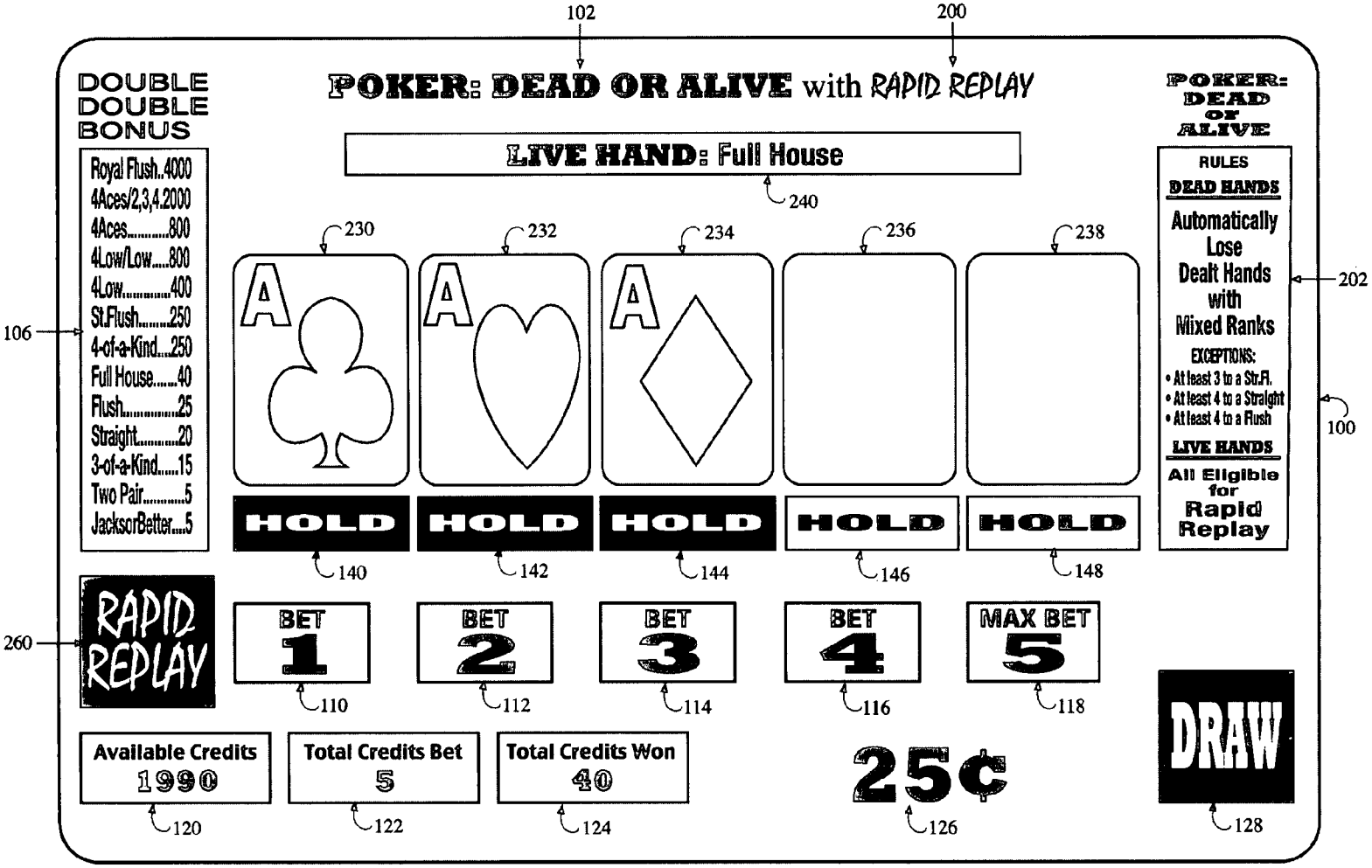
FIG. 6E shows the second hand of the second game at a later stage.

FIG. 6E refers to the elements in FIG. 6D wherein this time the player decides to hold only the Aces (230, 232, 234) by activating the Hold buttons (140, 142, 144). He then activates the Draw button 128. The two unheld cards (236, 238) have been discarded.

Figure 6F:
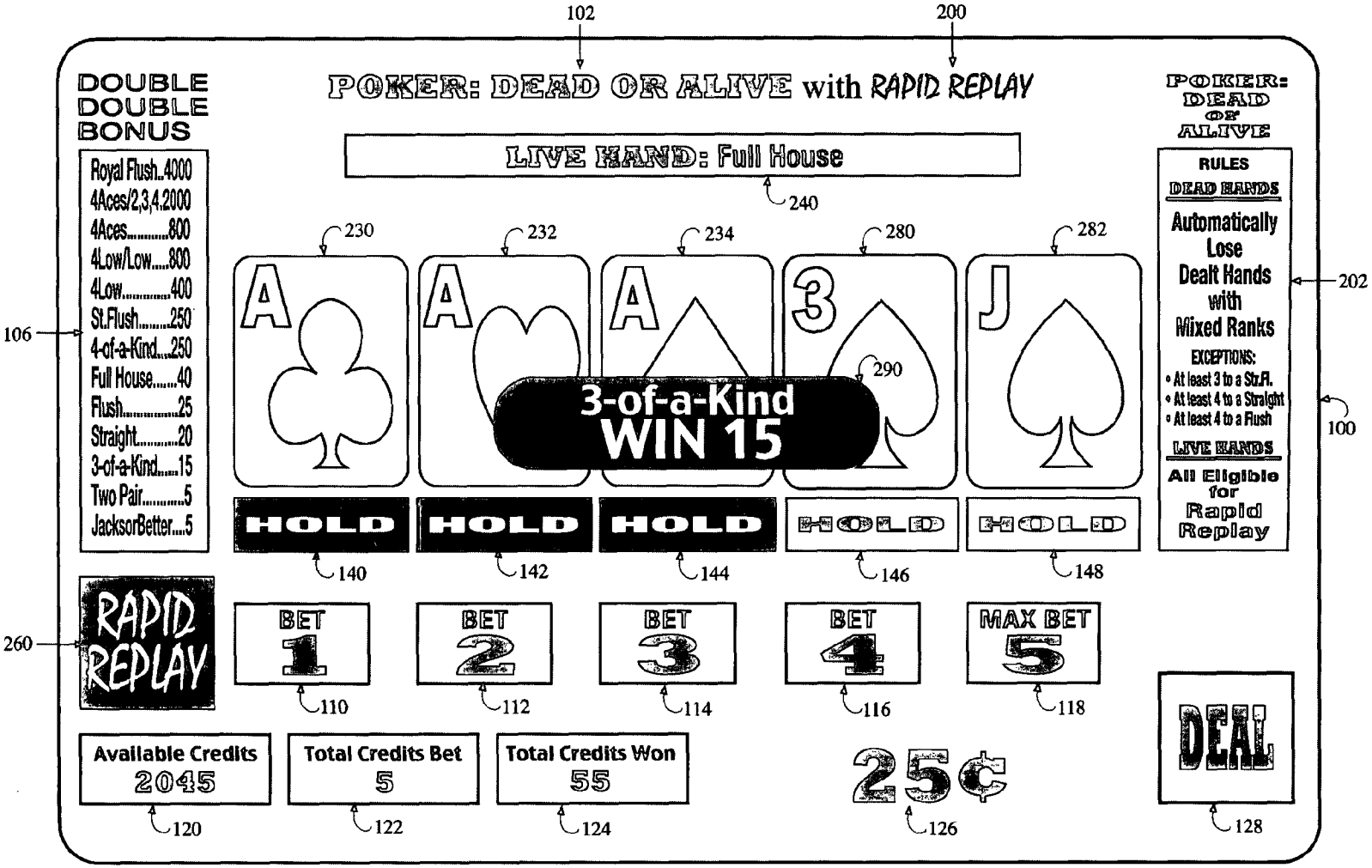
FIG. 6F shows the second hand of the second game at a final resolution stage.

FIG. 6F refers to the elements in FIG. 6E with the discarded cards being replaced by the 3 of Spades 280 and the Jack of Spades 282. (Note the Draw button 128 has changed to a Deal button.) The final hand is evaluated for wins, and the player is then notified that he has achieved a 3-of-a-Kind win for 15 credits, as shown in the box 290. As per the paytable 106, the Total Credits Won 124 are now shown as 55 credits, and the Available Credits 120 are now shown as 2045 credits.

Figure 7A:
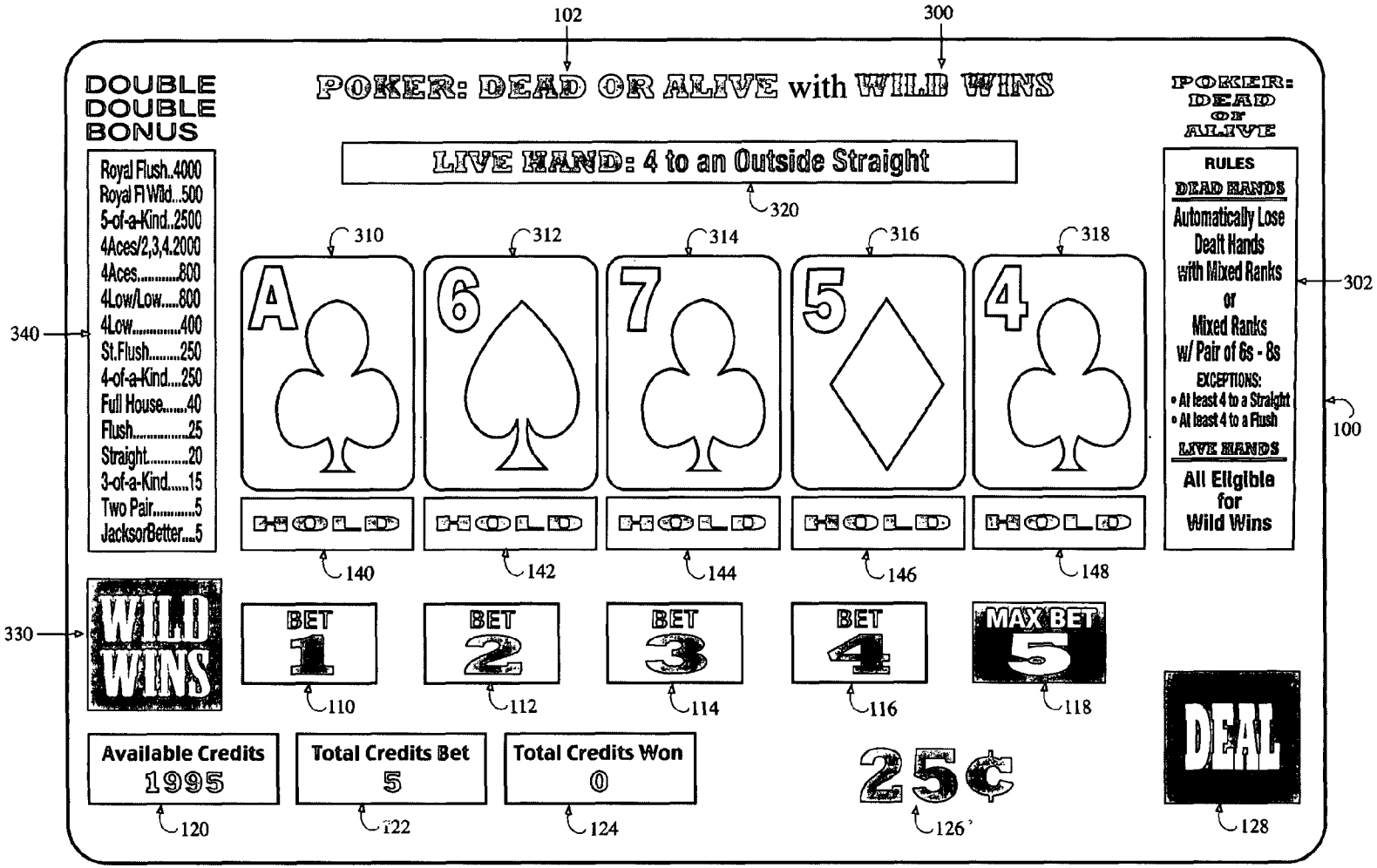
FIG. 7A shows a first hand of a third game of the present technology.

FIG. 7A shows a first hand of a third game of the present invention and refers to the basic gameplay elements as illustrated in FIG. 3A. In this third game, a different specific available bonus feature (herein called "Wild Wins") 300 is displayed on the screen 100. The Wild Wins feature adds a Wild Card to the replacement deck when the feature is activated. Also displayed is a different rules table 302. The rules for this third game specify that the player will automatically lose initial (five-card) hands comprised of either all mixed ranks or all mixed ranks with a pair of 6s through 8s. Exceptions to these rules include initial hands that include at least four cards to an (outside) Straight or at least four cards to a Flush. In this example, the player has activated the Max Bet button 118, betting credits ($1.25). The Total Credits Bet 122 (5 credits) is shown, as is the player's Available Credits 120 (1995 credits). He then has activated the Deal button 128, receiving the five cards of the initial hand: the Ace of Clubs 310, the 6 of Spades 312, the 7 of Clubs 314, the 5 of Diamonds 316, and the 4 of Clubs 318. An information window 320 is displayed that explains that the reason the hand is "LIVE" is because it contains four cards to an outside Straight. The player is not obligated to select any specific cards for the final hand; that is, the cards in the initial hand (four cards to an outside Straight, in this case) that provide the reason for qualification do not necessarily have to be held for the final hand. The Wild Wins bonus feature 330 has randomly become activated for this hand, and a new paytable 340 is displayed. The new paytable additionally provides payouts for hands that include a Wild Card.

Figure 7B:
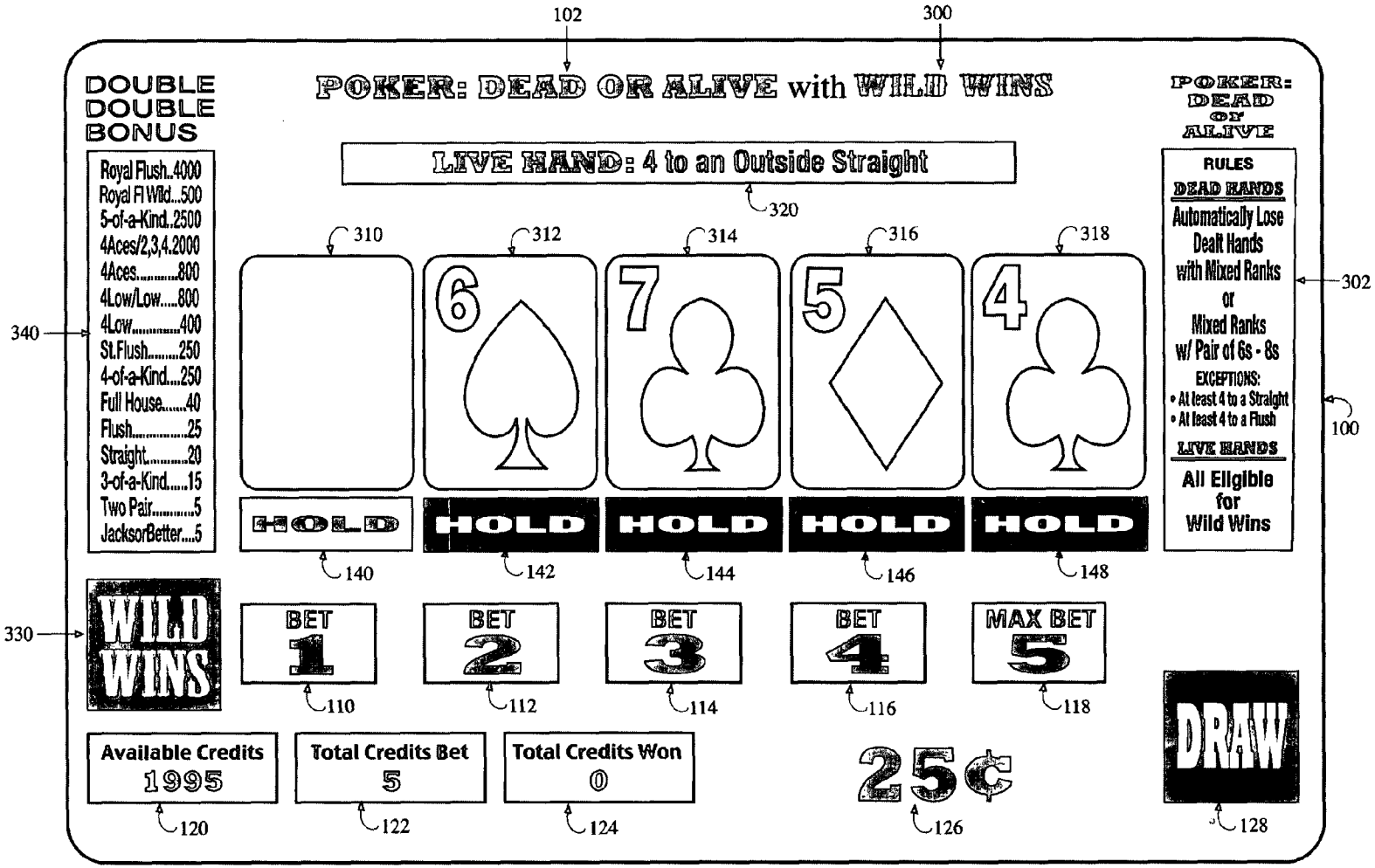
FIG. 7B shows the first hand of the third game at a later stage.

FIG. 7B refers to the elements in FIG. 7A wherein the player decides to hold the 6 of Spades 312, the 7 of Clubs 314, the 5 of Diamonds 316, and the 4 of Clubs 318 by activating the Hold buttons (142, 144, 146, 148) and then activating the Draw button 128. The one unheld card 310 has been discarded.

Figure 7C:
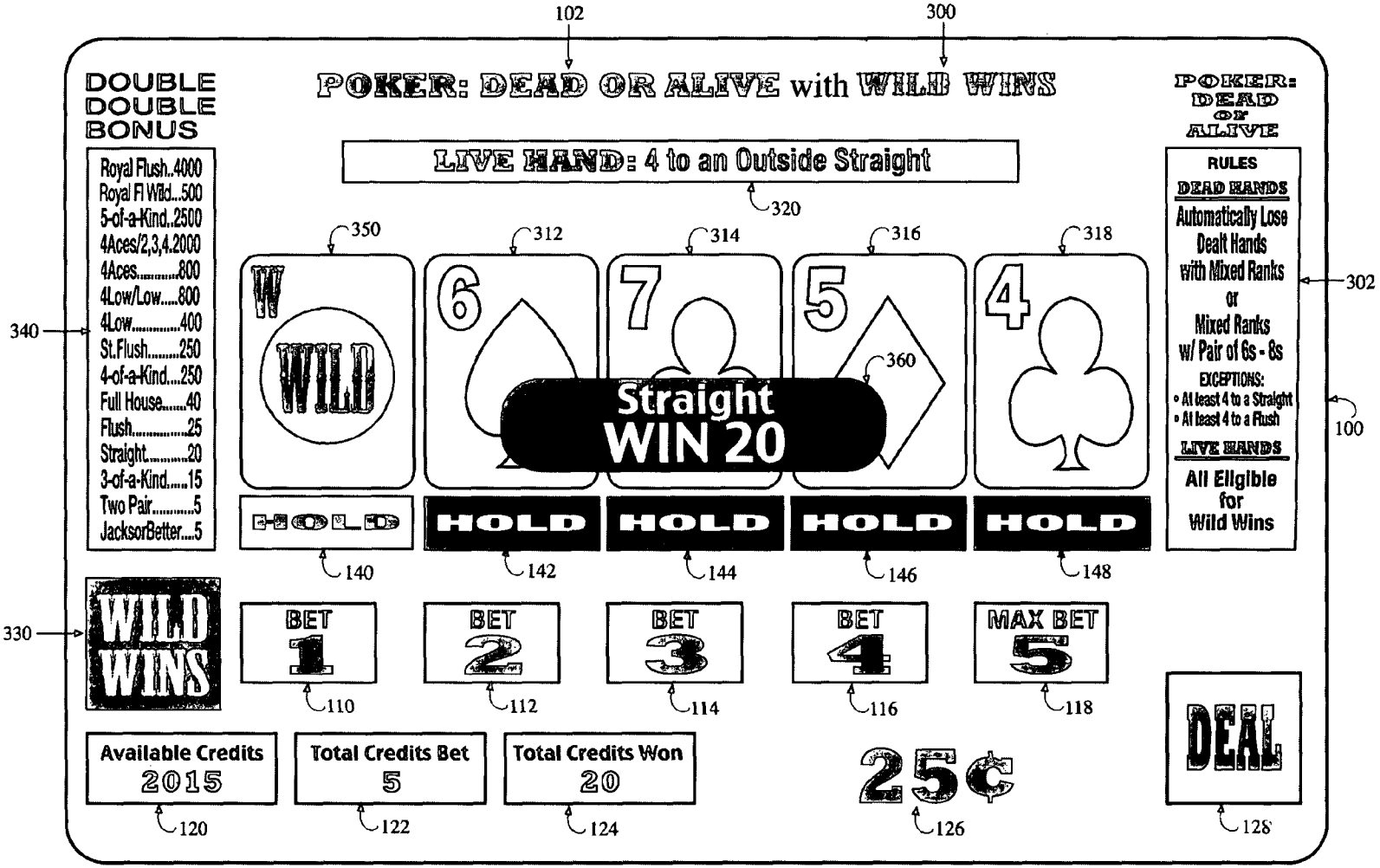
FIG. 7C shows the first hand of the third game at a final resolution stage.

FIG. 7C refers to the elements in FIG. 7B with the discarded card being replaced by the Wild Card 350. (Note the Draw button 128 has changed to a Deal button.) The final hand is evaluated for wins, and the player is then notified that he has achieved a Straight win for 20 credits, as shown in the box 360. As per the paytable 340, the Total Credits Won 124 is now shown as 20 credits, and the Available Credits 120 are now shown as 2015 credits.

Although specific examples and specific paytables have been provided in this discussion, these specifics are intended to be only support for the generic concepts of the invention and are not intended to be absolute limits in the scope of the technology discussed.

What is claimed:

1. A video poker machine comprising: a housing; at least one display device; at least one processor; at least one physical input device configured to detect a physical item associated with a monetary amount that establishes a credit balance; at least an electronic input device; and at least one memory device which stores a plurality of instructions which, when executed by the at least one processor, cause the at least one processor to operate with the at least one display device and the at least one electronic input device to:

a) establish a predetermined rules table associated with an initial five-card poker hand that determines whether or not the initial five-card poker hand is disqualified from continued play;

b) establish a predetermined paytable based on standard poker rankings associated with a final five-card poker hand ranking;

c) establish an initial deck of playing cards to be used in the play of the poker game;

d) enable a player, using the at least one electronic input device, to make a wager on a five-card poker hand, thereby decrementing the credit balance by the amount of the wager;

e) display to the player five cards face up representing the initial poker hand;

f) establish a depleted deck of playing cards representing the initial deck of playing cards less the five cards of the initial poker hand;

g) prevent the player from continuing play of the initial poker hand if the initial poker hand is disqualified;
h) discard the disqualified initial poker hand;
i) quality all initial poker hands that are not disqualified;
j) allow the player to continue play of the initial poker hand if the initial poker hand is qualified;
k) provide an eligibility for a special function to be activated on the qualified initial poker hand;
l) if the special function has been activated, provide the special function on the qualified initial poker hand;
m) enable the player, using the at least one electronic input device, to select none, one, a plurality or all of the face up cards from the qualified initial poker hand as cards to be held;
n) discard from the qualified initial poker hand each card that was not held;
o) randomly provide replacement cards from the depleted deck to complete a final five-card poker hand;
p) determine the poker hand ranking of the final poker hand;
q) make an award based on the paytable to the player if the final poker hand is a winning hand according to the paytable;
r) modify the award if modification is inherent in the special function;
s) provide the award by increasing the credit balance by the size of the award; and
t) initiate a payout associated with the credit balance after an actuation of a cashout button is received.

2. The video poker machine of claim 1 wherein the predetermined rules provide a predetermined set of disqualifying initial hands.

3. The video poker machine of claim 2 wherein the composition of the predetermined set of disqualifying initial hands determines an additional house advantage over and above the house advantage inherent in the paytable.

4. The video poker machine of claim 3 wherein the additional house advantage determines the configuration of the special function.

5. The video poker machine of claim 1 wherein the special function may be activated only on qualified hands.

6. The video poker machine of claim 1 wherein the special function may be activated after the deal of the initial hand, after the choice to hold none, any, or all of the dealt cards, after the player has locked in his choice, or after the hand has been evaluated for wins.

7. The video poker machine of claim 1 wherein the special function may be activated randomly, pseudo-randomly, or on every qualified hand according to a mathematical analysis.

8. The video poker machine of claim 1 wherein the special function includes one or more of a) providing a bonus multiplier, b) adding a Wild Card to the replacement deck, c) adding at least one additional card to the replacement deck, d) providing at least one extra hand, e) providing at least one replay of the initial hand, f) providing extra credits, g) providing free play, h) providing an enhanced paytable, i) providing player points, or j) providing a bonus game differing from the base poker game.

9. The video poker machine of claim 1 wherein the poker hand may instead consist of three, four, six or seven cards.

* * * * *